United States Patent [19]

McKinney

[11] 4,161,288

[45] Jul. 17, 1979

[54] FLUID DISPENSER METHOD AND APPARATUS

[75] Inventor: James C. McKinney, Atlanta, Ga.

[73] Assignee: Creative Dispensing Systems, Inc., Atlanta, Ga.

[21] Appl. No.: 729,798

[22] Filed: Oct. 5, 1976

[51] Int. Cl.[2] ..... B65D 47/34

[52] U.S. Cl. ..... 239/333; 222/380; 222/385; 222/472; 222/494; 222/497; 239/464; 239/526; 239/539; 239/570; 239/574; 239/579

[58] Field of Search ..... 239/331, 333, 464, 491, 239/492, 493, 526, 539, 337, 354, 452, 456, 570, 574, 577, 579, 583, 586; 222/380, 383, 467, 472, 481, 482, 494, 497, 385, 341, 384

[56] References Cited

U.S. PATENT DOCUMENTS

| | | | |
|---|---|---|---|
| 2,169,779 | 8/1939 | Loewe | 222/472 X |
| 2,362,080 | 11/1944 | Martin | 239/468 X |
| 2,805,891 | 9/1957 | Sanborn | 222/494 X |
| 3,187,960 | 6/1965 | Gorman | 222/380 X |
| 3,493,179 | 2/1970 | Lee | 239/493 X |
| 3,685,739 | 8/1972 | Vanier | 239/333 |
| 3,761,022 | 9/1973 | Kondo | 239/333 |
| 3,840,157 | 10/1974 | Hellenkamp | 222/385 X |
| 4,013,229 | 3/1977 | Rohs | 239/493 |

FOREIGN PATENT DOCUMENTS

| | | | |
|---|---|---|---|
| 629809 | 9/1949 | United Kingdom | 239/491 |

*Primary Examiner*—Robert B. Reeves
*Assistant Examiner*—Andres Kashnikow
*Attorney, Agent, or Firm*—L. Lawton Rogers, III; John F. Sieberth; E. Donald Mays

[57] ABSTRACT

A fluid pump dispenser includes a dispenser trigger which may be located in pivotable engagement with the dispenser housing and pump piston after shipment. The initial actuation of the trigger moves the pump piston and a container conduit, engaged thereto, to open a container vent shipping seal provided by mating surfaces on the conduit and the container cap. Fluid carried from the container by the conduit enters the pump chamber through a central orifice in the piston. A flexible member located on the piston functions as an inlet check valve for the conduit and as a piston ring. The fluid dispenser also includes a nozzle structure having a flexible member which functions as an outlet check valve and O-ring seal, and which cooperates with a threaded nozzle cap to vary the discharge pattern of the dispenser responsive to twisting adjustment of the cap.

26 Claims, 15 Drawing Figures

FLUID DISPENSER METHOD AND APPARATUS

BACKGROUND OF THE INVENTION

Aerosol dispensers widely used in the packaging industry present two major problems, atmospheric pollution from the propellant and disposal of the cannister without the risk of explosion and the accompanying hazard to personal safety. The use of hand actuated pump dispensers as a substitute for aerosol dispensers obviates these problems but is not practical in many circumstances because conventional pump dispensers are difficult to ship and expensive to construct. Accordingly, it is a primary object of the present invention to provide a novel fluid dispenser which is inexpensively fabricated and easily shipped.

Typically, fluid dispensers are attached to fluid containers prior to shipping. In order for fluid to be withdrawn from the container, a venting passage from the atmosphere to the interior of the container must be provided. However, unless the dispenser or container is provided with means for sealing the venting passage, fluid often leaks from the container during shipping. One known approach to this problem is a vent seal which may be disabled by tightening a cap over the nozzle. By way of example, this approach is illustrated in the Powers U.S. Pat. No. 3,780,951, dated Dec. 25, 1973. Another known approach to the problem is the provision of a releasable locking pin to maintain the piston in a position which blocks the vent. In this approach, the pin must be manually released before the trigger can be operated. This approach is illustrated, e.g., in the Hellenkamp U.S. Pat. No. 3,840,157, dated Oct. 8, 1974. These conventional seals and locking structures may be difficult for the consumer to operate, generally requiring the production of explanatory literature, and often entail considerable additional production expense due to the necessity of producing additional parts and of performing additional manufacturing steps in the fabrication of the structure. It is accordingly, an object of the present invention to provide a novel fluid dispenser with an easily and inexpensively fabricated vent shipping seal which does not require explanatory literature and which may be released by actuation of the dispenser trigger.

Because of the expense associated with the assembly, it is desirable that the number of separately molded parts of a fluid dispenser be minimized. It is, accordingly, an object of the present invention to provide a novel pump dispenser with an integral container conduit and vent shipping seal, an integral piston and inlet check valve seat, and/or an integral piston seal and inlet check valve member.

The operation of the trigger and its retention in the dispenser housing is often a problem and it is yet another object of the present invention to provide a novel pump dispenser in which the length of the piston stroke is utilized to retain the trigger operably connected to the housing. In the preferred embodiment, this is accomplished by directly connecting the piston with an actuating arm of the dispenser trigger to thereby limit the arc through which the trigger may pivot.

Fluid pump dispensers are generally provided with a nozzle structure including a check valve for blocking communication between the pump chamber and a nozzle aperture. A nozzle structure of this type is illustrated, e.g., in the Vanier U.S. Pat. No. 3,685,739, dated Aug. 22, 1972. It is desirable that the nozzle structure be adjustable to provide widely varying discharge patterns and for disabling the outlet check valve. A seal must also be provided to prevent fluid leakage at the sliding interface of the nozzle structure adjustment means. It is, of course, also desirable that the number of separately molded parts of the fluid dispenser be minimized. Accordingly, it is an object of the present invention to provide a novel fluid dispenser having an adjustable nozzle for varying the discharge pattern of the dispenser comprising only two separately molded parts attached to the dispenser housing.

It is desirable that a fluid dispenser have a large, protruding, and easily grasped trigger defining a long lever arm for actuating the dispenser pump. Dispensers having such easily grasped triggers are often difficult to economically and safely package for shipping. It is an object of the present invention to obviate such shipping problems by providing a novel dispenser having a large, easily operated trigger which may be conveniently and easily attached to the dispenser housing after delivery of the dispenser.

The triggers of many conventional fluid dispensers are attached to the dispenser housing with rivets or pins. This method generally requires the fabricating of additional parts and the performing of additional production steps to insert the pin or rivet. An example of this type of trigger connection is illustrated in the Hellenkamp U.S. Pat. No. 3,840,157, dated Oct. 8, 1974.

In another known method of assembly, the trigger is attached to the dispenser housing by outwardly flexing the lateral walls of the dispenser housing to permit the engagement of mating surfaces on the trigger and housing. This method of assembly has a disadvantage in that flexure may damage the relatively fragile dispenser mechanism or the housing by exceeding the limit of elastic deformation. Accordingly, it is an object of the present invention to avoid the expense of rivet attachment and the danger of housing damage by providing a novel, rivetless fluid dispenser trigger which may be pivotably attached in the dispenser housing without laterally flexing the housing.

These and many other objects and features of the present invention will be apparent from the claims and from the following description when read in conjunction with the appended drawings.

THE DRAWINGS

DETAILED DESCRIPTION OF PREFERRED EMBODIMENTS

A preferred embodiment of the fluid dispenser of the present invention includes a fluid supply and discharge assistant having a pump chamber and a piston moveable therein. The piston is formed with a conduit and an orifice providing communication between the pump chamber and a fluid container. The piston is actuated by a trigger pivotably engaged to the dispenser housing by a spiral-shaped member and the arc through which the trigger is pivotable may be limited by the piston stroke. The orifice of the piston functions as a valve seat, cooperating with a moveable, elastic member, to provide an inlet check valve for the pump cylinder. The valve member is integral with an elastic piston ring and a container vent passage is defined between an outer wall of the piston conduit and an inner wall of the container closure. Mating surfaces on the conduit and closure walls are adapted to block the vent passage when the surfaces are axially aligned. The vent passage may be unblocked by pivoting of the trigger to move the piston relative to the closure to thereby disengage the mating surfaces. The fluid dispenser also includes a nozzle structure having an aperture through which the fluid is discharged and an outlet check valve for blocking communication between the aperture and the pump chamber responsive to pressure in the pump. The check valve comprises a valve seat and an elastic valve member. The nozzle structure includes a nozzle cap for making adjustable pressural contact with the elastic valve member to vary the discharge pattern of the dispenser. Fluid flow between the cap and elastic member is deflected by bosses of varying heights on the cap of the elastic member.

To facilitate an understanding of the methods and structures of the present invention, reference may be had to the following:

TABLE OF CONTENTS

A. Fluid Dispenser Structure
B. Method of Assembling and Venting
C. Operation of the Fluid Supply and Discharge Assistant
D. Operation of the Nozzle Structure.

A. Fluid Dispenser Structure

Figure 1:
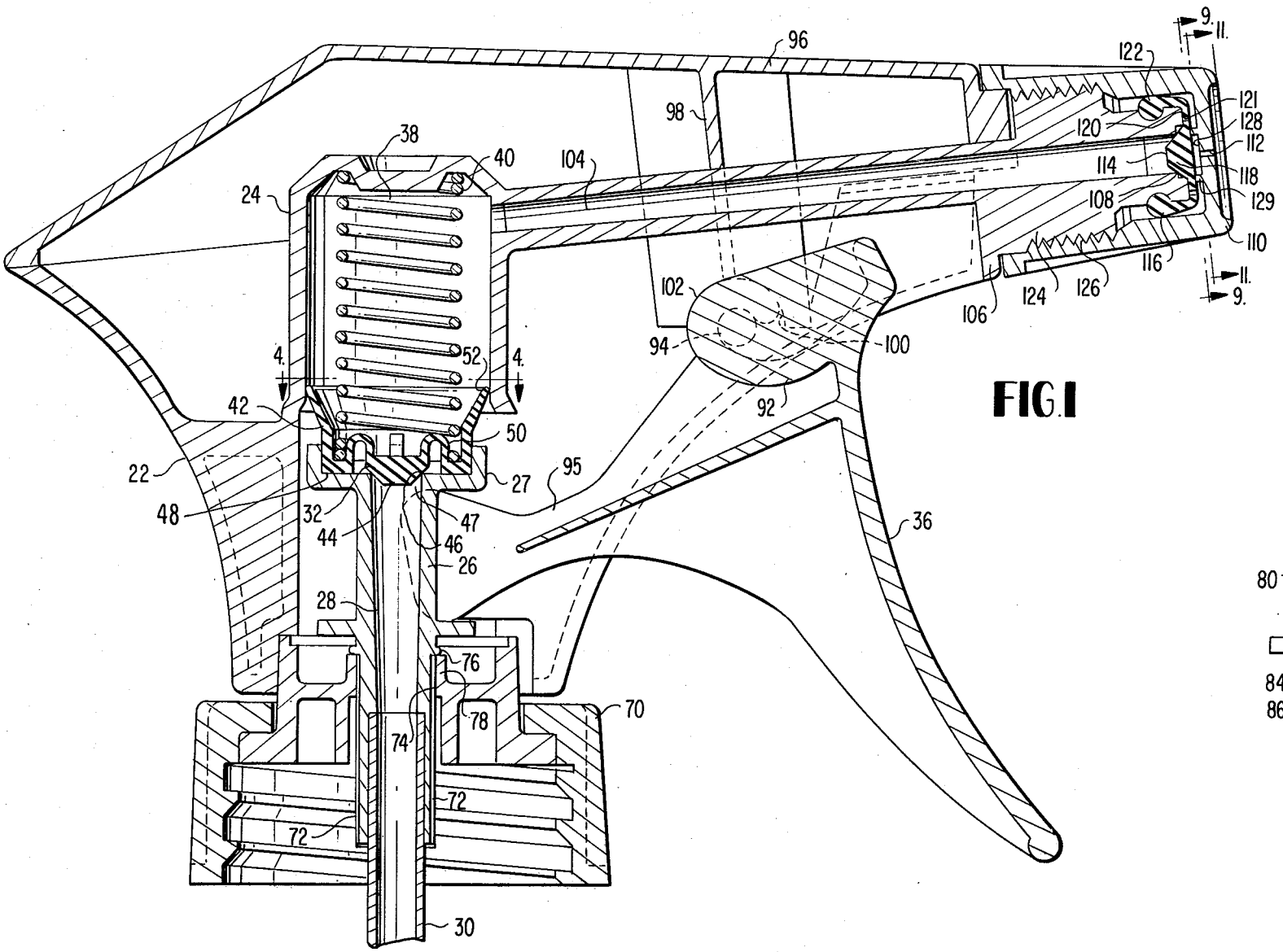
FIG. 1 is a sectional view in elevation taken through the major axis of one embodiment of the dispenser of the present invention.

With reference to FIG. 1, a fluid dispenser includes a housing 22 adapted for mounting on the threaded orifice of a fluid container (not shown). A pump chamber 24 is disposed within the housing 22. A fluid supply and discharge assistant 26 includes a piston 27 and a conduit 28 which provides fluid to the pump chamber 24 from the container. The piston conduit 28 may be provided with an inlet conduit 30 adapted to extend into the container to draw fluid into the pump chamber 24 via the piston conduit 28 and an inlet check valve 32. The piston 27 may be actuated against the bias of a coil spring 40 by squeezing trigger 36 thereby reducing the enclosed volume 38 of the pump chamber 24.

A flexible member 42 in contact with the piston 27 functions as the movable portion of the inlet check valve 32 and as a piston ring. Alternatively, the flexible member may be formed integral with the piston 27, as shown in FIG. 1. The flexible member 42 may include a central portion 44 adapted to contact a valve seat 46 integral with the piston to block a piston conduit orifice 47 and thereby block communication between the container and the pump chamber in response to the pressure within the pump chamber. The central portion 44 of the flexible member 42 may be frustoconical in shape to facilitate sealing engagement with the valve seat 46. In an alternate embodiment, the piston conduit may be blocked in response to pressure within the pump chamber by a ball check valve (not shown).

The flexible member may further comprise an annular portion 48 contacting the piston and the coil spring 40. A plurality of radially oriented, arch-shaped bands 50 of a thinner cross section than the central portion may be used to connect the central portion to the annular portion and permit relative movement therebetween. A radial edge 52 of the flexible member 42 may form a fluid tight seal between the piston 27 and the inner wall of the pump chamber 24.

Figure 4:
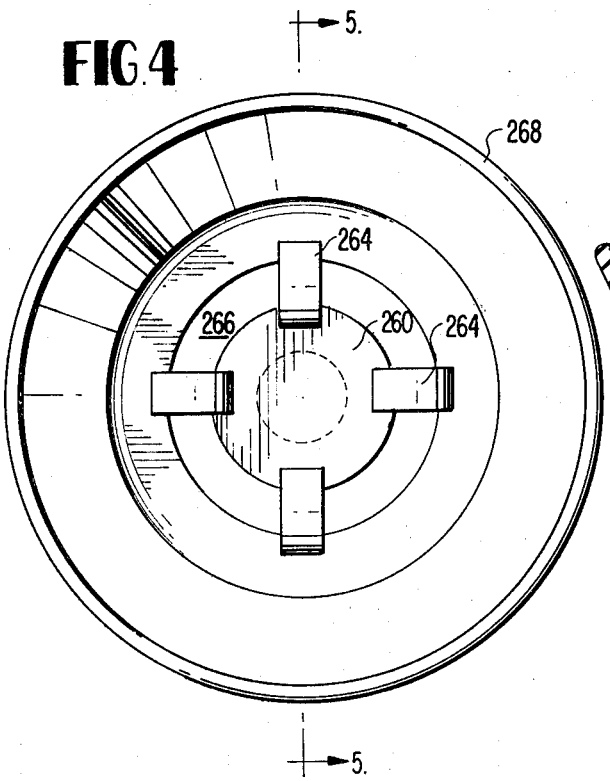
FIG. 4 is a section taken along lines 4—4 of FIG. 1.
Figure 5:
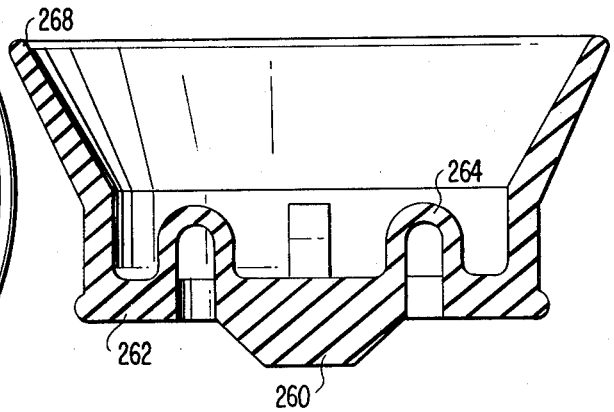
FIG. 5 is a section taken along lines 5—5 of FIG. 4.

As shown in the section illustrated in FIG. 4, the various portions of the flexible member described above have concentric relationships. The central portion 260 of the flexible member is attached to the piston engaging, annular portion 262 of the flexible member by a plurality of the arch-shaped bands 264. Apertures 266 in the flexible member lie between the bands 264 and a peripheral edge 268 of the flexible member is adapted to contact the inner wall of the pump chamber. Reference may also be had to FIG. 5, where the features of the flexible member of FIG. 4 are illustrated.

Referring once more to the dispenser illustrated in FIG. 1 and more particularly to the vent shipping seal, the piston conduit 28 may pass through an aperture in the container closure 70. The outer wall 72 of the conduit 28 and the inner wall 74 of the aperture of the container closure may define a container venting passage formed by axial indentations in either the conduit wall 72 or the wall of the closure 74. A venting passage may also be provided by a loose fit between the piston conduit and the container closure aperture. Mating surface 76 of the piston conduit and mating surface 78 of the container closure may be provided to block the venting passages when the mating surfaces are engaged.

Figure 2:
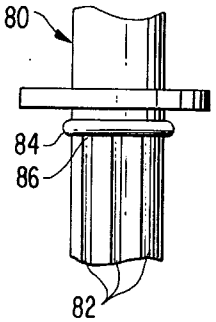
FIG. 2 is a pictorial view of the piston inlet conduit of the embodiment of FIG. 1 illustration the container vent passages.

A preferred embodiment of the vent shipping seal is illustrated with reference to FIG. 2. In FIG. 2, a piston conduit or inlet conduit of a spray dispenser 80 contains indentations or grooves 82 in the outer wall of the conduit 80 to define, together with the surface of the inner wall of the container closure, venting passages for the container. A raised ring 84 axially displaced from the upper ends 86 of the indentations 82 may be operative to block the venting passages when engaged with the surface of a groove in the inner wall of the aperture of the container closure. The mating surface 84 depicted in FIG. 2 as a raised ring may alternately be configured as a groove so long as the desired seal is obtained.

With continued reference to FIG. 1, the trigger 36 of the dispenser has a spiral-shaped member 92 which pivots on an inwardly projecting peg 94 on opposite sides of the dispenser housing. It may be noted that single or plural spiral-shaped members may be formed in either the housing or the trigger and single or plural pegs may be formed in the other of the housing and trigger.

The housing of the dispenser may include a separate housing head portion 96. The housing head portion 96 may be formed with a downwardly depending ear 98 for engaging the spiral-shaped member 92. A curved surface 100 of the ear 98 may slidably engage a portion 102 of the spiral-shaped member to prevent the spiral-shaped member from disengaging the pegs 94.

An arm 95 of the trigger is adapted to mate with the piston and piston conduit thereby limiting the arc through which the trigger may pivot to the length of the piston stroke. Fluid in the pump chamber 38 may be discharged from the dispenser through an outlet conduit 104 and a nozzle structure 106. The nozzle structure 106 may include a valve seat 108 communicating with the outlet conduit 104 and a nozzle cap 110 having an aperture 112 through which the fluid is discharged. An outlet check valve 114 includes flexible member 116 and the valve seat 108. A movable central portion 118 of the flexible member 116 may contact the valve seat 108 to block communication between the aperture 112 and the pump chamber 38 responsive to pressure within the pump chamber 38.

The central portion 118 of the flexible member may be frustoconical in shape with the central portion 118 surrounded by an annular portion 120 having apertures 121 to provide a fluid flow path when the central portion is not seated on the valve seat. An integral O-ring 122 is provided by the peripheral portion of the flexible member 114 to form a seal between the nozzle cap 110 and the housing 124 surrounding the outlet conduit.

The housing 124 and the nozzle cap 110 may be provided with threads 126. Rotation of the nozzle cap 110 with respect to the housing 124 may be operative to adjust the pressural contact between the inner central surface 128 of the nozzle cap and the central portion of the flexible member 118. Either the central portion of the flexible member 114 or the inner central portion of the nozzle cap 128 may be formed with bosses 129 for contacting the other of the cap or flexible member. The bosses may be operative to deflect the flow of fluid adjacent the bosses. Adjustment of the nozzle cap may vary the contact between the central portion of the flexible member and the bosses when the outlet check valve is open, thereby varying the discharge pattern of the dispenser.

Figure 9:
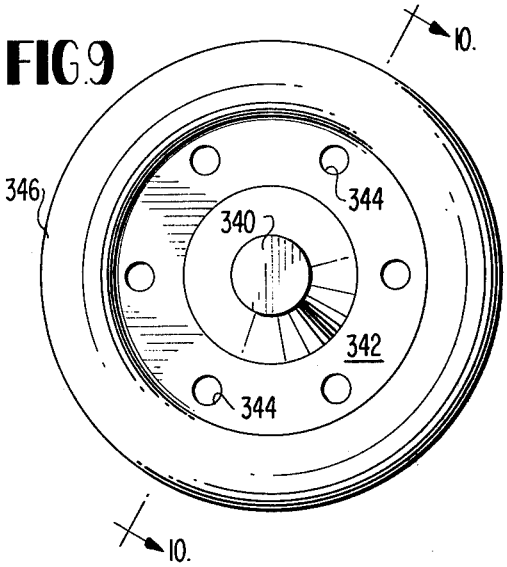
FIG. 9 is a section taken along lines 9—9 of FIG. 1.

As shown in FIG. 9, the flexible member 116 of FIG. 1 has a central, frustoconical portion 340 surrounded by an apertured annular region 342. The apertures 344 provide fluid flow passages between the outlet conduit and the aperture in the nozzle cap when the check valve is open. The O-ring portion (not shown) of the flexible member is attached to the peripheral edge 346 of the apertured annular portion 342 of the flexible member.

Figure 10:
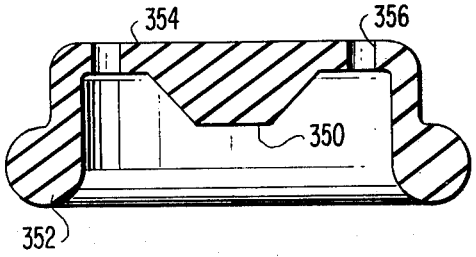
FIG. 10 is a section taken along lines 10—10 of FIG. 9.

As shown more clearly in FIG. 10, the frustoconical portion 350 of the flexible member is connected to the integral O-ring 352 by the apertured annular portion 354 may be thinner in cross section than the central portion 350 to permit relative movement of the central portion 350 with respect to the O-ring 352. Apertures 356 in the annular portion 354 may provide fluid flow passages through the member.

Figure 12:
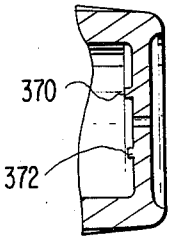
FIG. 12 is a section taken along lines 12—12 of FIG. 11.
Figure 11:
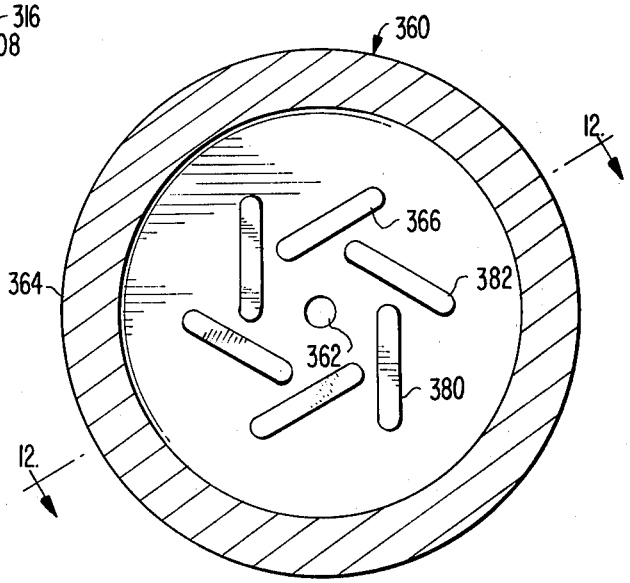
FIG. 11 is a section taken along lines 11—11 of FIG. 1.

FIG. 11 is a cross sectional view taken along lines 11—11 of FIG. 1. As shown in FIG. 11, the nozzle cap 360 includes an aperture 362 formed in the central circular wall 364 of the nozzle cap. Bosses 366 may be formed on the central inner surface of the nozzle cap and, as shown in FIG. 12, the bosses 370 and 372 may be of different heights. In one embodiment of the invention, adjacent bosses may be of alternate heights, bosses 380 of FIG. 11 may be of one height while bosses 382 are of a different height.

B. Dispenser Assembly and Venting

Figure 3:
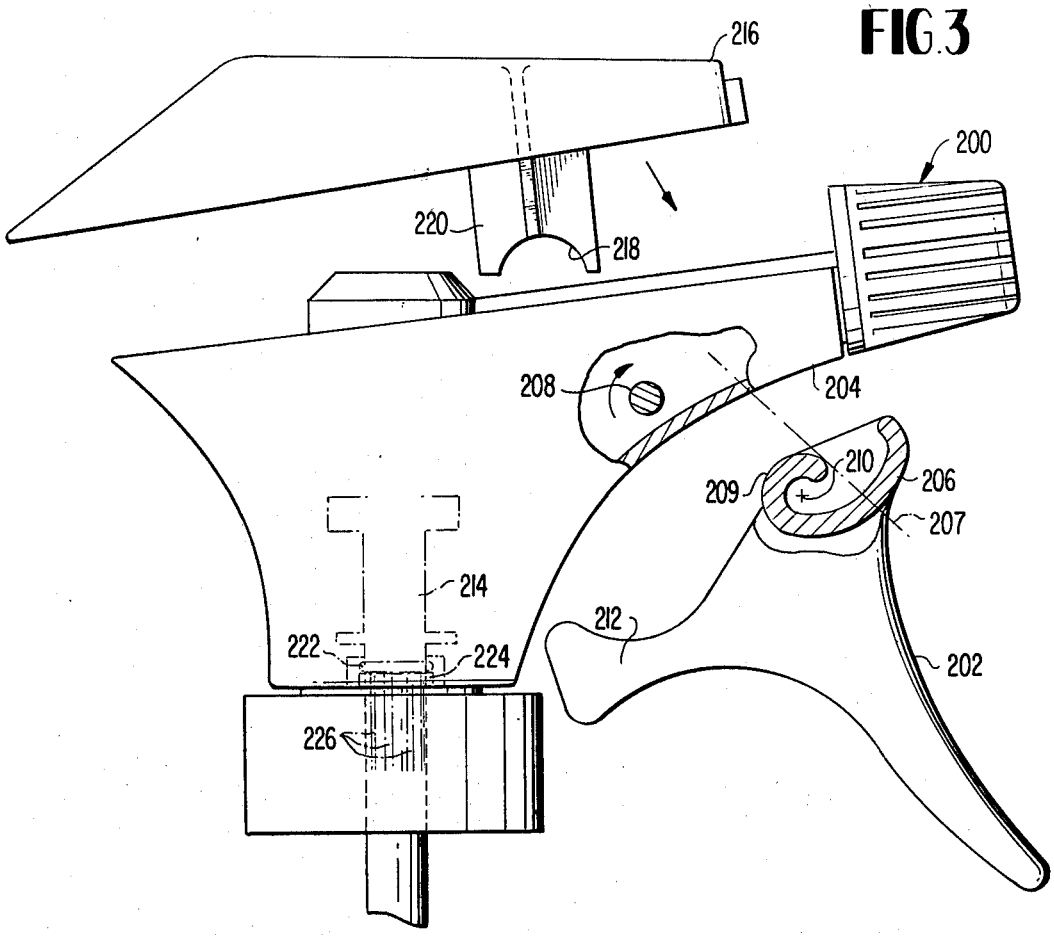
FIG. 3 is a pictorial view in partial section of an embodiment of the present invention illustrating a trigger assembly method.

The assembly and venting of the fluid dispenser of FIG. 1 may be understood more readily by reference to FIG. 3 where a fluid dispensor 200 is illustrated as including a trigger 202 pivotably engaging the housing 204. This engagement may be accomplished by interengaging the spiral member 206 on the trigger with a peg 208 on the housing so that the center of the peg is located in the interior space defined by the spiral between line 207 and the tightly curved portion of the spiral 209. Advantageously, the peg may be located at the center 210 of the shortest radius of the spiral. At the same time an arm 212 of the trigger may be mated with the discharge assistant 214 (shown in phantom). The head portion 216 of the housing 204 may then be positioned so that the curved surface 218 of the downwardly depending ear 220 of the housing head may slidably contact a portion of the spiral-shaped member 206 to prevent the spiral-shaped member from disengaging the peg 208.

Once the trigger 202 is pivotably mounted to the housing, the container (not shown) may be vented by squeezing the trigger toward the central portion of the housing 204 to cause upward motion of the discharge assistant 214. This upward motion may cause the radially outward flexing of mating surface 222 from the mating surface 224 thereby causing the surfaces to disengage and move axially with respect to one another to open venting passages 226. This permits air to enter the container to displace fluid removed by the pumping action of the dispenser.

C. Fluid Supply and Discharge Assistant Operation

The operation of the pumping mechanism of the fluid dispenser may be more easily understood with reference to FIG. 1 where it can be seen that the initial squeezing of the trigger 36 toward the central portion of the dispenser operates to disengage the vent seal as described above and to reduce the enclosed volume of the pump chamber 38 to discharge air via the outlet conduit 104, the valve seat 108, the flexible member apertures 121 and the nozzle cap aperture 112. When the trigger 36 is released, the coil spring 40 urges the piston 27 downwardly to increase the enclosed volume of the pump chamber and thus reduce the pressure therein. This reduction in pressure in the pump chamber may cause the central portion 118 of the flexible member 116 to seat on the valve seat 108 to close the outlet check valve. This reduction in pressure in the pump chamber may likewise cause the central portion 44 of the flexible member 32 to unseat from valve seat 46 to open the inlet check valve and cause fluid to be drawn from the container into the pump chamber via the inlet conduit 30, the piston inlet conduit 28, the piston conduit orifice 47 and the apertures in the flexible member 32. Air may enter the container along vent passages 72 to compensate presurally for the withdrawal of fluid from the container.

Further squeezing of the trigger 36 may be operative to drive the piston upwardly once more to reduce the enclosed volume of the pump chamber 38. This reduction in volume discharges fluid from the pump chamber via the outlet conduit 104, the check valve 114, the apertures 121 and the nozzle cap aperture 112. This increased pressure in the pump chamber is also operative to open the inlet check valve 114 by unseating the central portion 118 of the flexible member 116 from valve seat 108. A series of fluid discharges from the dispenser may be obtained by the alternate squeezing and releasing of the trigger.

D. Nozzle Structure Operation

Figure 6:
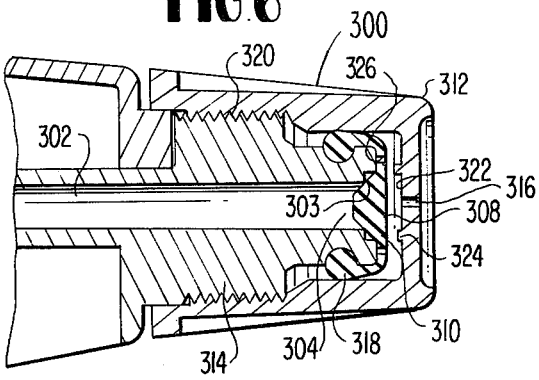
FIGS. 6–8 are sections of the nozzle structure of the embodiment of the present invention illustrated in FIG. 1 showing the adjustment of the structure to vary the nozzle discharge pattern.
Figure 7:
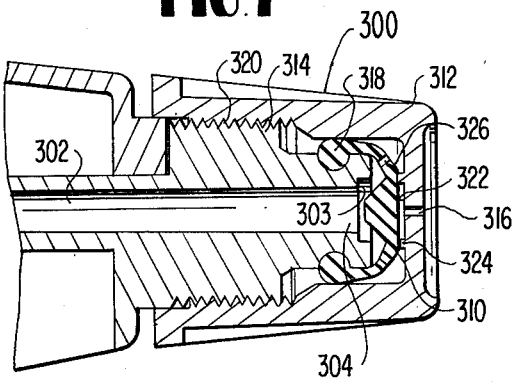
Figure 8:
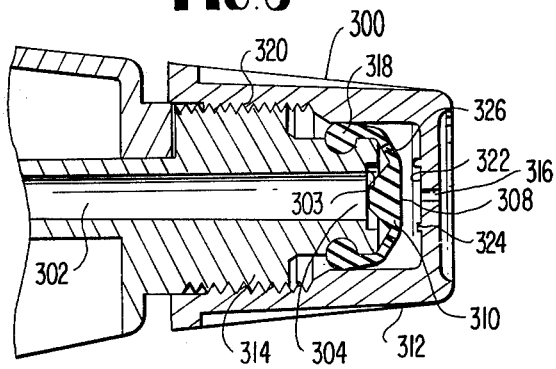

The operation of the spray dispenser nozzle structure may be understood with reference to FIGS. 6 through 8. As shown in FIG. 6, fluid may be supplied to the nozzle structure 300 via a conduit 302. An orifice 304 of the conduit 302 forms a valve seat 303 for an outlet check valve 306, and a frustoconical shaped central portion 308 of the flexible member 310 may be utilized to block the orifice 304 in response to pressure within the conduit 302. If the pressure in the conduit 302 is less than the ambient pressure about the nozzle structure, the central portion 308 of the flexible member may be seated on the valve seat 303 as shown in FIG. 6. When the pressure in the conduit exceeds the ambient pressure the central portion 308 of the flexible member may be unseated from the valve seat 303 as shown in FIG. 7 and FIG. 8 where like features of FIG. 6 are identified with like numbers.

With reference to FIGS. 6, 7 and 8, a nozzle cap 312 may be provided for threaded engagement with the portion 314 of the dispenser defining conduit 302 and may be formed with an aperture 316 through which fluid is discharged from the dispenser. The nozzle cap engages an O-ring portion 318 of the flexible member to retain the periphery of the flexible member in a fixed position with respect to the valve seat 303 and to provide a fluid tight seal between the nozzle cap and the conduit defining portion 314 of the dispenser. Rotation of the nozzle cap 312 along the path defined by the threads 320 may vary the distance and/or pressural contact between the central portion of the flexible member and the inner central surface 322 of the nozzle cap. Bosses 324 may be formed in either the inner central surface 322 of the nozzle cap or the central portion 308 of the flexible member to deflect fluid flow. Alternatively, fluid directing recesses may be formed in either the inner central surface 322 of the nozzle cap or the central portion 308 of the flexible member to direct fluid flow.

Figure 15:
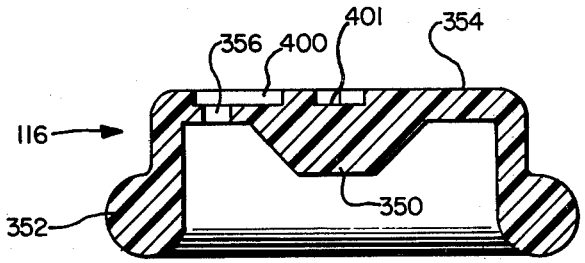
FIG. 15 is a section taken along lines 15—15 of FIG. 13.
Figure 13:
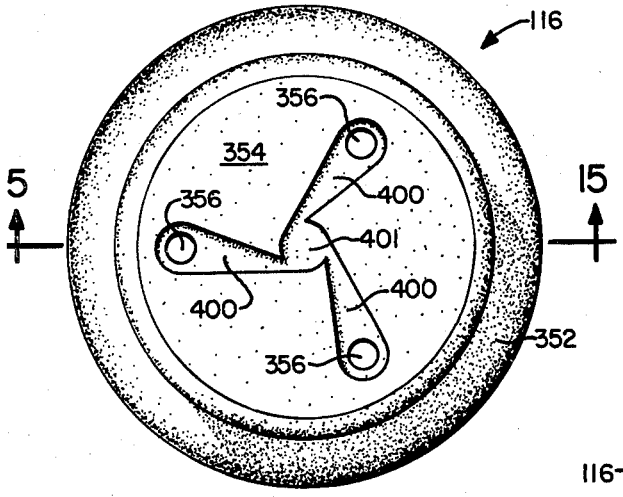
FIG. 13 is a top plan view of another embodiment of the outlet check valve.
Figure 14:
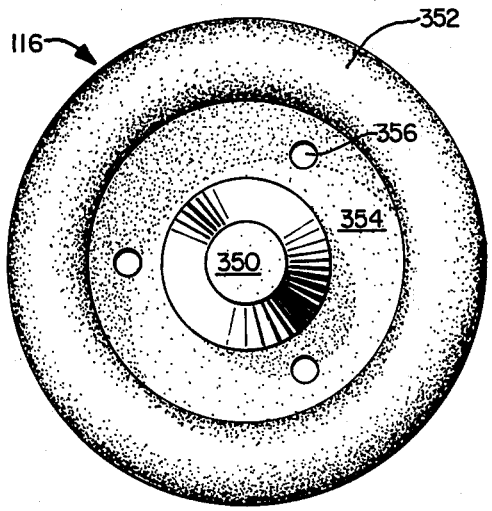
FIG. 14 is a bottom plan view of the outlet check valve of FIG. 13.

A second embodiment of the flexible outlet valve member, designated 116 generally, is shown in FIGS. 13, 14 and 15. In this embodiment, the flexible outlet valve member has the same general construction as shown in FIGS. 9 and 10, i.e., a frusto-conical or central portion 350, an integral O-ring 352, an apertured central or annular portion 354, provided with apertures 356. Additionally, as seen in FIGS. 13 and 15, the apertured annular portion 354 is provided with three separate inwardly directed recesses 400 whereby the flow of fluid from the apertures 356 is directed to a central swirl chamber 401 which is positioned opposite the aperture 316 in the cap 300.

As shown in FIG. 7 and FIG. 8, fluid pressure in the conduit 302 may unseat the central portion 308 of the flexible member from the valve seat 303 and be discharged from the aperture 316 via the orifice 304 and the apertures 326 in the flexible member. When the cap is positioned with respect to the flexible member as shown in FIG. 7, the discharged fluid must pass between bosses 324 before it is discharged through aperture 316, and, therefore, is swirled. The resultant discharge pattern may be a spray dispensed over a relatively wide area. When the nozzle cap is positioned with respect to the flexible member as shown in FIG. 8, the fluid may pass from apertures 326 in the flexible member through aperture 316 in the nozzle cap without passing between the bosses 324, and is not swirled by the bosses. The resultant discharge pattern may, therefore, be in the form of a stream.

Where bosses of varying heights are provided the discharge pattern of the sprayer may be varied by selectively adjusting the nozzle cap to selectively cause contact between the flexible member and some or all of the bosses when the outlet check valve opens.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes therefore may be made by those skilled in the art without departing from the spirit and scope of the present invention.

What is claimed is:

1. An apparatus for dispensing fluids from a container comprising:

a housing;

a trigger;

means for pivotably mounting said trigger to said housing including a member configured in an open spiral on one of said housing and said trigger and a peg on the other one of said housing and said trigger configured for disposition within the interior space defined by said spiral shaped member;

a pump chamber having a piston movable through a limited stroke responsive to said trigger for varying the volume of said pump chamber, whereby the limits of the piston stroke limit the pivoting movement of said trigger;

an outlet valve having a valve member for blocking communication with said chamber responsive to the pressure in said chamber;

a nozzle cap for adjustably contacting said outlet valve member to vary the discharge pattern of the fluid dispensed;

inlet conduit means attached to said piston and communicating with the container, providing a venting passage for the container selectively blocked by mating surfaces on said conduit means and container responsive to movement of the piston; and a flexible member slidably contacting the wall of said pump chamber for blocking communication between said pump chamber and said inlet conduit means responsive to the pressure in said chamber.

2. The apparatus of claim 1 further including means for preventing the peg from disengaging the spiral member.

3. The apparatus of claim 2 wherein said housing comprises a body portion and a head portion, said peg being formed in the body portion of the housing; and, wherein said disengagement preventing means comprises an ear formed in the head portion of said housing, said ear having a curved surface for engaging said spiral shaped member while permitting relative rotation of said peg and said spiral member.

4. The apparatus of claim 1 wherein the valve member of said outlet valve includes an O-ring portion which contacts said nozzle cap and a central portion for blocking communication with said chamber responsive to the pressure in said chamber.

5. The apparatus of claim 1 wherein one of said nozzle cap and said outlet valve member is formed with bosses for imparting a swirl to fluid dispensed from said nozzle.

6. The apparatus of claim 5 wherein the bosses are of different heights so that adjustment of the clearance between said nozzle cap and outlet valve member may vary the discharge pattern of the apparatus.

7. The apparatus of claim 1 wherein said inlet conduit means includes an axially elongated indentation in the outer wall of said inlet conduit to provide the venting passage for the container.

8. The apparatus of claim 7 wherein said mating surfaces provide a detent action for maintaining said piston in a position relative to the container to block the venting passage thereby preventing leakage from the container.

9. The apparatus of claim 1 wherein said piston and said flexible member are integral.

10. A fluid dispenser including:

a housing;

a trigger;

a pump actuated by motion of said trigger; and, means for pivotably engaging the trigger to the housing without piercing the trigger or housing and without flexing said housing in a direction normal to the direction in which fluid is dispensed, said means comprising:

a spiral-shaped member on one of said housing and said trigger, and a peg means on the other of said housing and said trigger for pivotably engaging said spiral-shaped member whereby the dispenser may be assembled by moving said peg and said spiral-shaped member relative to one another to locate said peg in the interior space of said spiral-shaped member.

11. The dispenser of claim 10 further comprising means carried by said housing for preventing said spiral-shaped member from disengaging said peg means.

12. The dispenser of claim 11 wherein said spiral shaped member is carried by said trigger; and, wherein said housing includes a first portion for carrying said peg means; and, second portion for carrying an ear with a surface curved for slidably contacting a portion of the spiral-shaped member.

13. The dispenser of claim 10 wherein said pump includes a piston and wherein said trigger includes an arm mating at one end with the piston of said pump when said trigger is in an operable position whereby the limits of the piston stroke limit the arc through which the trigger is pivotable to thereby prevent disengagement of said peg means and said spiral-shaped member.

14. In a fluid dispenser having a housing with lateral walls, a trigger, a pump actuated by motion of the trigger, the trigger depending from between the lateral walls of the housing, a method for pivotably engaging the trigger to the housing without piercing the lateral walls of the housing or laterally spreading the walls of the housing comprising the steps of:

(a) providing a sprial-shaped member on one of the trigger and housing;

(b) providing a laterally extending peg on the other of the trigger and housing;

(c) positioning the peg within the spiral of the spiral-shaped member; and (d) inhibiting relative motion of the peg away from the center of the shortest radius of the spiral-shaped member to thereby prevent the member from disengaging the peg.

15. The method of claim 14 wherein the pump includes a piston operated by the trigger and where relative motion is inhibited by mating an arm of the trigger with the piston so that the stroke limits of the piston limit the relative rotation between the peg and the spiral-shaped member.

16. The method of claim 14 wherein relative motion is inhibited by pressural engagement of the spiral shaped member with a surface on a separate head portion of the housing, curved to permit relative rotation between the peg and the spiral shaped member about the axis of the peg.

17. In a dispensing apparatus having a variable volume pump chamber for discharging fluid from the apparatus, a valve member for a pump chamber inlet check valve, said valve member being flexible and adapted to engage a valve seat in a sealing relationship, said flexible member including:

a relatively stiff central portion adapted to engage the valve seat in a sealing relationship therewith;

a relatively flexible intermediate portion having at least one aperture therein; and, a radially outwardly extending peripheral sealing edge for slidably contacting the interior wall of the pump chamber.

18. In a dispensing apparatus having a variable volume pump chamber for discharging fluid through an outlet conduit, an outlet check valve and an apertured nozzle cap, the improvement wherein the terminal end of the outlet conduit forms the valve seat for the outlet check valve, wherein the valve member of the outlet check valve includes:

a relatively rigid central portion for sealably engaging and disengaging the valve seat responsive to pressure in said outlet conduit;

a relatively flexible intermediate portion having at least one aperture therein; and, an O-ring peripheral portion sealably engaging the radially inner surface of a nozzle cap in a sliding relationship thereto; and, wherein said nozzle cap which is selectively positionable to variably limit the excursion of said valve member from the valve seat.

19. The apparatus of claim 18 wherein said nozzle cap may be selectively positioned to contact the central portion of said valve member to maintain said central portion in contact with said valve seat thereby disabling the outlet check valve.

20. The apparatus of claim 18 wherein fluid-directing recesses are formed in one of the front face provided on said valve member and the rear face provided on the cylindrical front portion provided on the nozzle cap.

21. In a dispensing apparatus including a fluid container, a container closure and a pump chamber, the volume of which is varied by motion of a piston to discharge fluid from the apparatus, the improvement comprising an inlet conduit attached to said piston and communicating between the container and the pump chamber, at least a portion of the outer wall of said inlet conduit being provided with indentations which, together with the inner wall provided on the container closure, provide a container venting passage, said inlet conduit having at least one surface for engaging the container to block the venting passage, the container and conduit surface being disengageable responsive to motion of the piston.

22. The improvement of claim 21 wherein said container engaging surface provides a detent inhibiting movement of said piston and inhibiting unblocking of the venting passage, thereby facilitating the shipment of the dispensing apparatus with fluid in the container without leakage.

23. The improvement of claim 22 wherein the venting passage is unblocked by movement of said piston responsive to initial activation of a trigger for actuating said piston.

24. In a fluid dispenser having a housing, a fluid container and a pump with a trigger operated piston, a method of assembling and venting the fluid dispenser comprising the steps of:

providing a spiral-shaped member on one of the trigger and housing;

providing a peg on the other of the trigger and housing;

providing an inlet conduit attached to the piston and communicating between the container and the pump, said inlet conduit defining a venting passage for the container blocked by mating surfaces on the conduit and container;

pivotably mounting the trigger by engaging the peg within the spiral of the spiral-shaped member;

engaging the trigger with the piston; and actuating the trigger to move the piston to thereby unblock the venting passage.

25. In a dispensing apparatus including an inlet check valve for controlling fluid communication between an inlet conduit and a pump chamber, the volume of which pump chamber is varied by a piston, the improvement comprising a flexible member, attached to the piston, having a first, peripheral portion slidably contacting the wall of the pump chamber to provide a sliding seal between the piston and the pump chamber, and having a second portion movable responsive to pressure within the chamber to block communication between the inlet conduit and the pump chamber.

26. The apparatus of claim 25 wherein the second portion of the flexible member is a relatively rigid central portion attached to said first portion by at least one flexible arch-shaped band, said central portion being configured to seat on a valve seat to thereby block communication with the inlet conduit.

* * * * *